United States Patent [19]

Nishikawa et al.

[11] 4,446,787

[45] May 8, 1984

[54] PREPARATIVE MONITORING APPARATUS FOR OPERATION OF A PRESS

[75] Inventors: Yoshinori Nishikawa, Kanazawa; Iwashige Takahashi, Komatsu, both of Japan

[73] Assignee: Kabushiki Kaisha Komatsu Seisakusho, Tokyo, Japan

[21] Appl. No.: 390,507

[22] Filed: Jun. 21, 1982

[51] Int. Cl.[3] ..... B30B 15/00

[52] U.S. Cl. ..... 100/99; 72/31

[58] Field of Search ..... 100/53, 99; 72/31; 340/680

[56] References Cited

U.S. PATENT DOCUMENTS

| | | | |
|---|---|---|---|
| 2,991,531 | 7/1961 | Gates | 100/99 X |
| 3,030,616 | 4/1962 | Onulak | 100/99 |
| 4,120,185 | 10/1978 | Schneider | 100/99 X |
| 4,195,563 | 4/1980 | Budraitis | 100/99 |

FOREIGN PATENT DOCUMENTS

| | | | |
|---|---|---|---|
| 122483 | 9/1979 | Japan | 100/99 |
| 2092755 | 8/1982 | United Kingdom | 100/99 |

*Primary Examiner*—Billy J. Wilhite

*Attorney, Agent, or Firm*—Spensley, Horn, Jubas & Lubitz

[57] ABSTRACT

A preparative monitoring apparatus for operations of a press displays interlock conditions relating to an operation currently in operation whose establishment is indespensable for the operation to be performed as well as the title of this operation. These interlock conditions are displayed by means of light emitting elements and the title is displayed by a display device provided on a panel. When either one of these interlock conditions is unestablished, the light emitting element corresponding to the unestablished condition and the display of the title are caused to flicker, thereby indicating occurrence of abnormality in the press.

2 Claims, 5 Drawing Figures

PREPARATIVE MONITORING APPARATUS FOR OPERATION OF A PRESS

BACKGROUND OF THE INVENTION

The present invention relates to a preparative monitoring apparatus for operation of a press.

Usually, any press operation is initiated only after it is confirmed that all interlock conditions with respect to an intended press operation such as slide adjustment, preparation for operation or the like have been completely established and if not, necessary remedial activities have been practiced until all of the interlock conditions are established.

In a prior art, a display as to the interlock conditions established prior to starting a press operation as well as a display that the required preparative operations for a press have been completed are undertaken by means of a display apparatus as illustrated in FIG. 1. A panel $P_{a1}$ includes a board B on which a variety of operations and interlock conditions are indicated. Further, a plurality of lamps LP are arranged on the board B in the form of a matrix in conformance with the respective operations and interlock conditions. Thus, the conventional display apparatus as mentioned above informs that the preparative operations have been completed when all the lamps corresponding to the intended operation are lit and thereafter one of preparation completion lamps $L_{f1}$ to $L_{f4}$ is lit, after all the interlock conditions corresponding to the intended operation have been established.

However, it is found with the conventional display apparatus that as the type and number of operations and interlock conditions increase, the number of lamps increases correspondingly and thereby an increased area is required for a panel, resulting in a necessity for a wider space where it is placed. Another drawback inherent to the conventional display apparatus is that it is manufactured at an expensive cost due to the arrangement of plural lamps corresponding to a certain interlock condition.

SUMMARY OF THE INVENTION

The present invention is intended to obviate the drawbacks with the conventional display apparatus as mentioned above.

Thus, it is an object of the present invention to provide a preparative monitoring apparatus for operation of a press which is characterized in that a title of a certain press operation is presented by means of display devices, that a plurality of lighting elements are provided which are adapted to be turned on so as to display the interlock conditions corresponding to said press operation, and that said lighting elements and display devices are intermittently turned on so as to present an existence of abnormality that the intended interlock conditions have been not established.

Another object of the present invention is to provide a preparative monitoring apparatus for operation of a press in which an area required for a display panel of the monitoring apparatus is substantially reduced.

Still another object of the present invention is to provide a preparative monitoring apparatus for operation of a press in which, when it is necessary to change the existing interlock conditions corresponding to a modified press operation, all that is to be done is to change or modify the content stored in the storage circuit in conformance with the changed interlock conditions without any necessity for increasing an area for the display panel.

BRIEF DESCRIPTION OF THE DRAWINGS

In the accompanying drawings.

DETAILED DESCRIPTION OF THE INVENTION

Now the present invention will be described in more detail with reference to the accompanying drawings.

Figure 1:
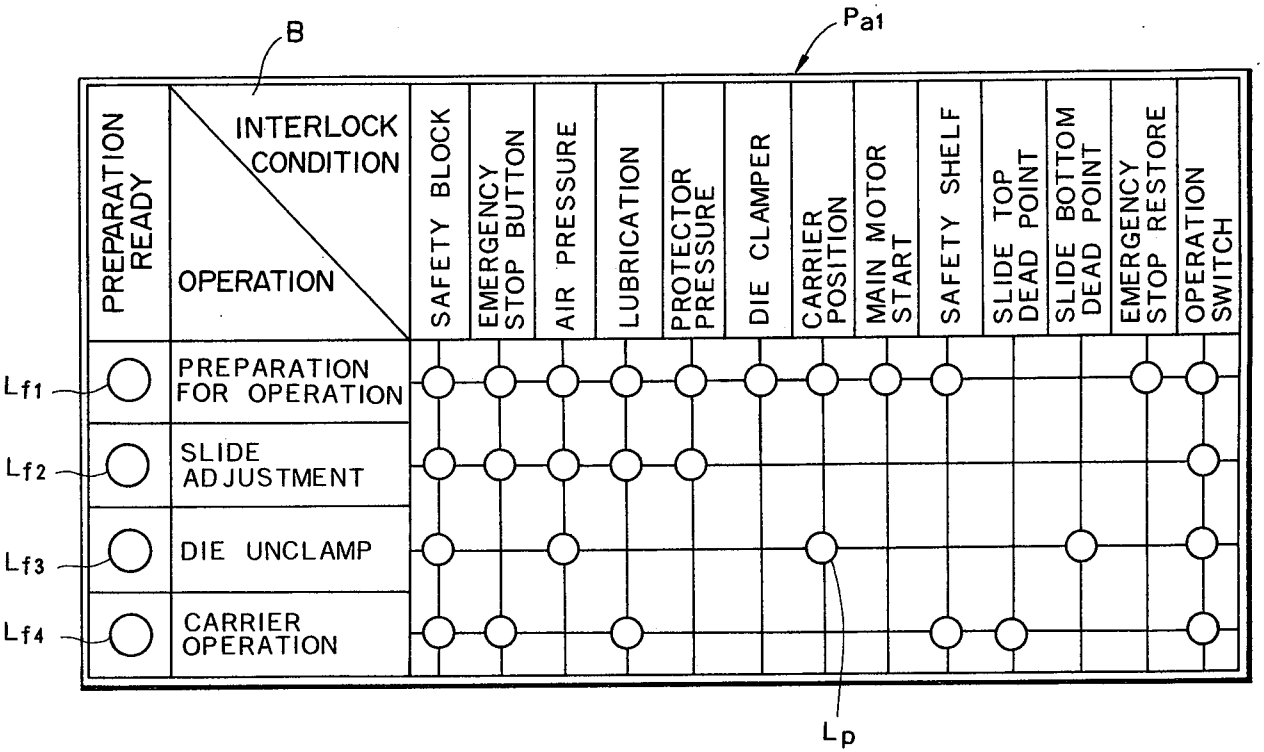
FIG.1 PRIOR ART
FIG. 1 shows a display panel of a conventional preparative monitoring apparatus for operation of a press.
Figure 2:
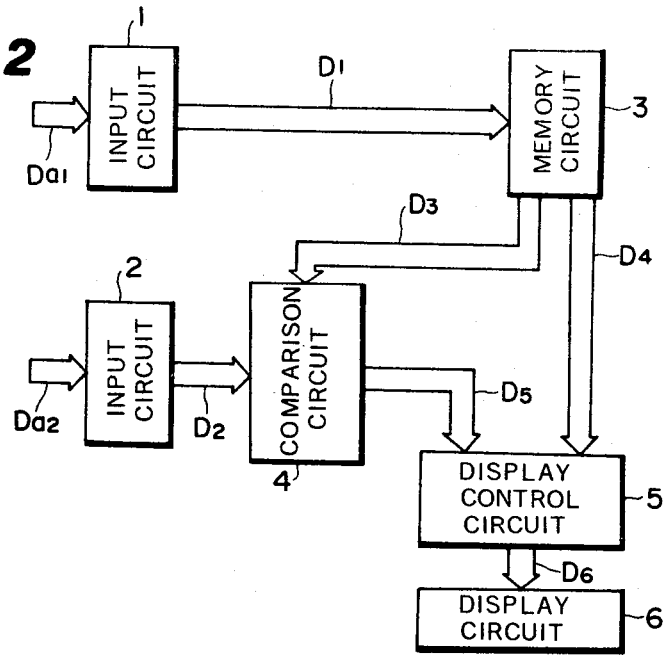
FIG. 2 is a block diagram illustrating a preparative monitoring apparatus in accordance with an embodiment of the present invention.

Referring to FIG. 2, when any one of press operation switches (not shown) is turned on, a corresponding operation switch signal $D_{a1}$ enteres a memory circuit 3 as an input signal $D_1$ by way of an input circuit 1. Then, a comparison signal $D_3$ relative to the interlock conditions of the intended operation enteres a comparison circuit 4 in response to the signal $D_1$ which has entered the memory circuit 3, whereas a letter group display signal $D_4$ enteres a display control circuit 5 for the purpose of displaying the title of the intended press operation.

Further, an interlock condition signal $D_{a2}$ generated in the press machine enters the comparison circuit 4 as a comparison signal $D_2$ by way of an input circuit 2. The comparison circuit 4 is constructed such that a comparison is made between the comparison signal $D_3$ representing a reference interlock conditions and the comparison signal $D_2$ representing the existing interlock conditions, and outputs a lighting signal $D_5$ for lighting lighting elements wich present interlock conditions corresponding to the press operation into a display control circuit 5. It should be noted that said lighting signal $D_5$ includes a signal which serves for intermittently activating said lighting lamp corresponding to interlock conditions which are not established.

The display control circuit 5 generates a display driving signal $D_6$ on the basis of both the display signal $D_4$ and the lighting signal $D_5$ and then said display driving signal $D_6$ enteres a display circuit 6. This display circuit 6 displays the interlock conditions as well as the title of the intended press operation in response to the entered signal $D_6$. When it is found that an interlock condition is not established, the same is identified by way of intermittent lighting and at the same time the title of the press operation corresponding to it is also lit intermittently.

Figure 3:
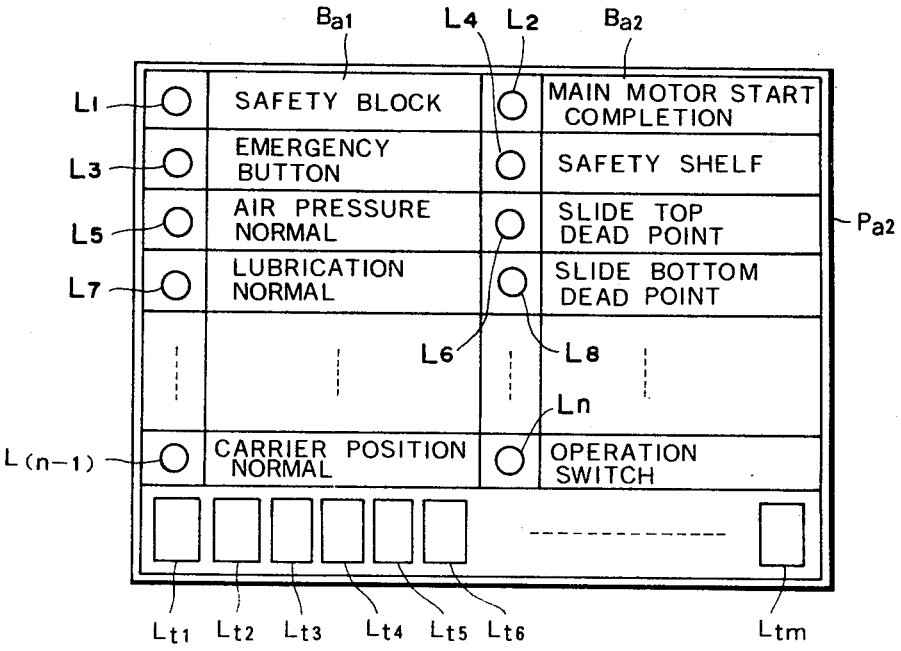
FIG. 3 shows a display panel of a preparative monitoring apparatus in accordance with an embodiment of the present invention.

FIG. 3 illustrates how a display is effected by the display circuit 6. A panel $P_{a2}$ includes display boards $B_{a1}$ and $B_{a2}$ on which a number of interlock conditions are indicated. Further, the panel $P_{a2}$ includes a plurality of lighting elements $L_1$ and $L_n$ such as light emitting diodes or the like which are located at a predetermined position corresponding to the respective interlock conditions (it should be noted that the suffix n shows the number of interlock conditions and lighting elements $L_9$ to $L_{(n-2)}$ are omitted from the drawing). Furthermore, the panel $P_{a2}$ includes a plurality of display devices $L_{t1}$ to $L_{tm}$ at the bottom part thereof which are intended to present the title of the press operations (it should be noted that the suffix m shows the number of letters which represent the title of the press operation and display devices $L_{t6}$ to $L_{t(m-1)}$ are omitted from the drawing). The display devices $L_{t1}$ to $L_{tm}$ are typically a 5×7 matrix type display device on which any letter display is available, for instance, English alphabets.

Figure 4:
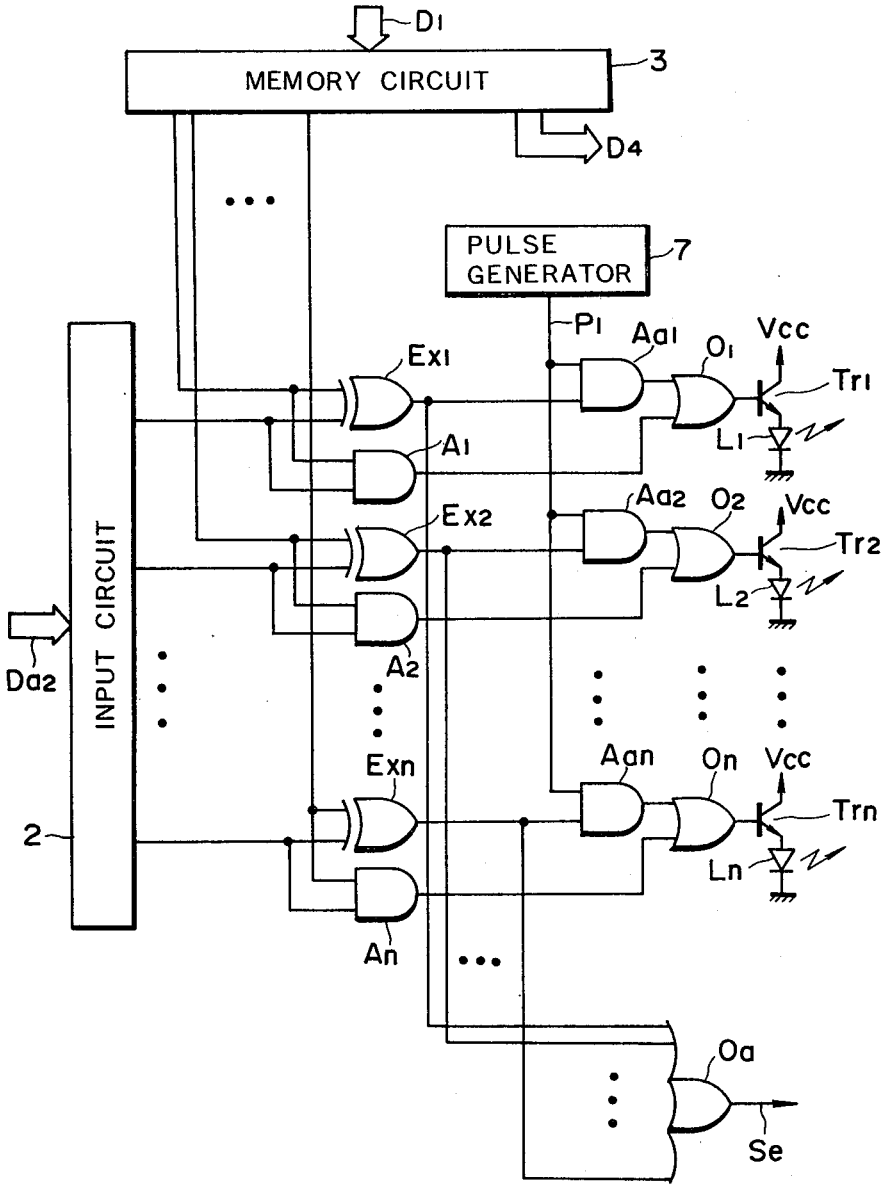
FIG. 4 is a block diagram illustrating a comparison circuit, a display control circuit relative to indication of interlock conditions and a display circuit for the preparative monitoring apparatus of the present invention.

FIG. 4 illustrates the comparison circuit 4, the display control circuit 5 relative to designation of the respective interlock conditions and the display circuit 6.

The operations of these circuits will be described below typically with reference to a safety block (one of the interlock conditions). When both the signals $D_2$ and $D_3$ relative to the safety block are "1", an exclusive OR circuit $E_{x1}$ and an AND circuit $A_1$ receives signal "1" respectively. Thus, the exclusive OR circuit $E_{x1}$ becomes inoperative and the AND circuit $A_1$ becomes operative, whereby a transistor $T_{r1}$ is turned on to light the lighting element $L_1$.

On the other hand, when both the signals $D_2$ and $D_3$ relative to the safety lock are "0", both the exclusive OR circuit $E_{x1}$ and the AND circuit $A_1$ becomes inoperative, whereby the transistor $T_{r1}$ is turned off and the lighting element $L_1$ is deenergized.

When the safety block condition is not established due to abnormality such as machine failure or the like and thereby the signals $D_2$ and $D_3$ relative to the safety block do not coincide with each other, the exclusive OR circuit $E_{x1}$ becomes operative and the AND circuit $A_1$ becomes inoperative. As a result, the AND circuit $A_{a1}$ is caused to operate at a frequency $t_1$ at which a pulse generator 7 generates an output pulse $P_1$. Thus, the transistor $T_{r1}$ is turned on and off at the frequency $t_1$ of the pulse $P_1$ and thereby the lighting element $L_1$ is lit intermittently.

Since the exclusive OR circuit $E_{x1}$ becomes operative, a signal $S_e$ by which the display for indicating the title of the press operation is intermittently lit enters the display control circuit 5 by way of the OR circuit $O_a$.

As described above, when the signals $D_2$ and $D_3$ representative of the reference and existing interlock conditions are identified by "1", the corresponding lighting elements $L_1$ to $L_n$ are turned on, whereas when these signals are "0", the lighting elements are turned off. On the other hand, when the signals $D_2$ and $D_3$ do not coincide with each other, the lighting elements $L_1$ to $L_n$ corresponding to the interlock conditions are intermittently turned on and at the same time the signal $S_e$ is produced so that the display for the title of the press operation is intermittently turned on. It should be noted that exclusive OR circuits $E_{x3}$ to $E_{x(n-1)}$, AND circuits $A_3$ to $A_{(n-1)}$, $A_{a3}$ to $A_{a(n-1)}$, OR circuits $O_3$ to $O_{(n-1)}$ and transistors $T_{r3}$ to $T_{r(n-1)}$ are omitted from FIG. 4.

Figure 5:
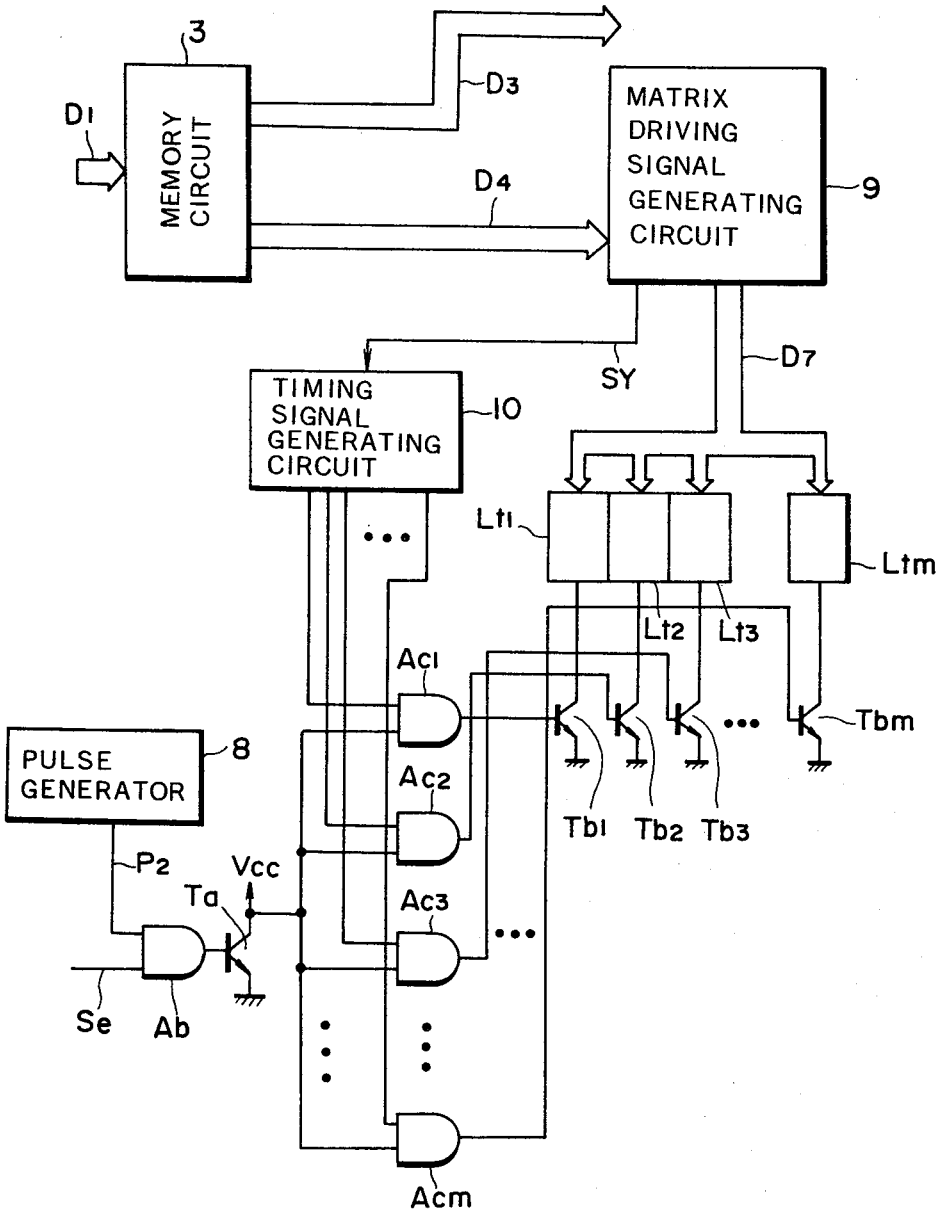
FIG. 5 is a block diagram illustrating a display control circuit relative to indication of the title of a press operation as well as a display circuit for the preparative monitoring apparatus of the present invention.

FIG. 5 illustrates the display control circuit 5 and the display circuit 6 relative to the display devices $L_{t1}$ to $L_{tm}$.

In FIG. 5, it is assumed that the signal $S_e$ is not produced by the comparison circuit 4, in the die unclamping operation. During the period of die clamping, an AND circuit $A_b$ is kept inoperative and a transistor Ta is turned off, whereby AND circuits $A_{c1}$ to $A_{cm}$ become operative (AND circuits $A_{c4}$ to $A_{c(m-1)}$ are omitted from the drawing).

The memory circuit 3 is constructed such that the letter group display signal $D_4$ corresponding to the input signal $D_1$ (corresponding to the die unclamping operation in this case) enteres a matrix driving signal generating circuit 9.

The matrix driving signal generating circuit 9 generates a matrix driving signal $D_7$ on the basis of the entered letter group display signal $D_4$ for representing the title of the press operation with the aid of English letters ("DIE UNCLAMP" in this case) and then the matrix driving signal $D_7$ enters all the display devices $L_{t1}$ to $L_{t2}$ at the same time. Further, the matrix driving signal 9 issues a synchronizing signal SY to a timing signal generating circuit 10 every time when a lighting signal $D_7$ equivalent to a single English letter enters the display deivdes $L_{t1}$ to $L_{tm}$.

Every time when the synchronizing signal SY is inputted, the timing signal generating circuit 10 generates a timing signal which is in turn issued to the AND circuits $A_{c1}$ to $A_{cm}$ one after another to activate them so that transistors $T_{b1}$ to $T_{bm}$ are turned on one after another.

In case it is intended to display the title of a press operation "DIE UNCLAMP", the first alphabet "D" is displayed by means of the display device $L_{t1}$ when the lighting signal $D_7$ corresponding to the alphabet "D" enters the display devices $L_{t1}$ to $L_{tm}$ and thereby the transistor $T_{b1}$ is turned on; the second alphabet "1" is displayed by means of the display device $L_{t2}$ when the lighting signal $D_7$ corresponding to the alphabet "L" enteres the display devices $L_{t1}$ to $L_{tm}$ and thereby the transistor $T_{b2}$ is turned on; and then the same steps are repeated in conformance with the order of alphabets constituting the title of the press operation "DIE UNCLAMP". It should be noted that an arrangement is made such that the transistor $T_{bm}$ is turned on and thereafter the transistor $T_{b1}$ is turned on.

Once it is detected by means of the comparison circuit 4 that the existing interlock condition is deviated from a reference one, the signal $S_e$ enteres the AND circuit $A_b$ and thereby the AND circuit $A_b$ is turned on at a frequency $t_2$ at which the pulse generator 8 generates the output pulse $P_2$ so that the transistor $T_a$ is turned on at the frequency $t_2$ of the pulse $P_2$. Thus, all the AND circuits $A_{c1}$ to $A_{cm}$ are turned off at the frequency $t_2$ of the pulse $P_2$ and then all the transistors $T_{b1}$ to $T_{bm}$ are turned off at the frequency $t_2$ of the pulse $P_2$. As a result a display of the display devices $L_{t1}$ to $L_{tm}$ is intermittently activated.

It should be noted that the frequency of the synchronizing signal SY is determined within such an extent that no fluctuation takes place when practicing a display by means of the display devices $L_{tl}$ to $L_{tm}$ and the frequency $t_2$ of the output pulse $P_2$ generated by the pulse generator 8 is determined sufficiently lower than the frequency of the synchronizing signal SY.

It will be readily apparent that the title of a press operation can be presented in Katakana alphabet (Japanese alphabet) or other alphabets when the display device for representing the title of the press operation is replaced with another one which is designed to display such alphabet and the letter group display signal $D_4$ in the memory circuit is modified to cope with display of such alphabet.

What is claimed is:

1. A preparative monitoring apparatus for operation of a press wherein interlock conditions relating to a press operation are displayed during said press operation, comprising:

a display circuit including a plurality of lighting elements for displaying said interlock conditions and a display device for performing display of title of selected operation;

memory means for storing a plurality of reference interlock conditions corresponding to a type of press operation, establishment of said reference interlock conditions being indispensable for said press operation; and a control circuit for comparing said reference interlock conditions with an actually established interlock conditions and for flickering said lighting elements corresponding to interlock conditions which do not coincide with said reference interlock conditions.

2. A preparative monitoring apparatus for operation of a press as defined in claim 1, further comprising a flickering circuit for flickering said display of title of selected operations if at least one of the interlock conditions corresponding to said selected operations is not established.

* * * * *